US006217282B1

(12) United States Patent
Stanka

(10) Patent No.: US 6,217,282 B1
(45) Date of Patent: Apr. 17, 2001

(54) VANE ELEMENTS ADAPTED FOR ASSEMBLY TO FORM A VANE RING OF A GAS TURBINE

(75) Inventor: Rudolf Stanka, Rattenkirchen (DE)

(73) Assignee: DaimlerChrysler AG, Stuttgart (DE)

( * ) Notice: Subject to any disclaimer, the term of this patent is extended or adjusted under 35 U.S.C. 154(b) by 0 days.

(21) Appl. No.: 09/138,983

(22) Filed: Aug. 24, 1998

(30) Foreign Application Priority Data

Aug. 23, 1997 (DE) ..... 297 15 180 U

(51) Int. Cl.[7] ..... F01D 1/02
(52) U.S. Cl. ..... 415/209.2; 415/209.3
(58) Field of Search ..... 415/189, 190, 415/191, 200, 208.2, 209.2, 209.3, 209.4, 210.1

(56) References Cited

U.S. PATENT DOCUMENTS 3,442,442 * 5/1969 Seiwert ..... 415/200
3,561,884 * 2/1971 Zerlauth ..... 415/218
4,832,568 * 5/1989 Roth et al. ..... 415/189
5,848,874 * 12/1998 Heumann et al. ..... 415/189

FOREIGN PATENT DOCUMENTS

128499 * 6/1950 (SE) ..... 415/209.4

* cited by examiner

*Primary Examiner*—Edward K. Look
*Assistant Examiner*—James M McAleenan
(74) *Attorney, Agent, or Firm*—Ladas & Parry

(57) ABSTRACT

A vane element adapted for assembly with a plurality of further vane elements to form a ring of vanes for a low pressure gas turbine. Each vane element has a vane blade with platforms at its outer and inner ends, the platform at the outer end being adapted for connection to a housing. Each platform has a flange integral with the vane blade and an outer wall spaced radially from the flange and joined thereto by a radial wall having a lateral projection. Opposite the projection, a recess is formed between the flange and the outer wall, the recess having a shape corresponding to that of the projection so that a plurality of the vane elements can be assembled to form the vane ring by engaging the projection of one vane element in the recess of an adjacent vane element. The projections are form-fit in the recesses so that the platforms of the vane elements are flush with one another.

20 Claims, 5 Drawing Sheets

VANE ELEMENTS ADAPTED FOR ASSEMBLY TO FORM A VANE RING OF A GAS TURBINE

FIELD OF THE INVENTION

The invention relates to a vane element for a gas turbine, particularly a low-pressure turbine, in which the vane element has a vane blade, which extends between an inner platform and an outer platform, the outer platform being secured to a housing by fastening means, the inner platform being adapted for being coupled to the inner platforms of adjacent vane elements.

The invention relates further to a vane segment assembled from at least three vane elements as well as to a ring of the vane elements formed by assembling the vane segments.

BACKGROUND

Vanes of low-pressure turbines have been made of metal and are generally soldered together first to form segments of three or six vanes and then to form the annular ring. For investigations of aerodynamic dimensioning of the profile of the vane blades as well as for incorporation in an actual gas turbine drive mechanism, a number of vane segments are secured together to form a ring of blades in which individual vane segments are not rigidly connected to one another in order to accommodate thermal expansion. The vanes are fastened by their outer platforms in a drive housing and are detachably connected to one another at their inner platforms by metal clamps or the like. By clamping the vanes at the inner platforms, the vibration behavior of the vane blades is improved. The use of clamps as additional components, however, has the disadvantage of more extensive assembly and higher costs.

For calibrating the aerodynamic dimensioning process and for rapid determination of test data for alternately measuring pressure, velocity and flow quantity, vanes made substantially of carbon-fiber-reinforced plastics are utilized and are tested in so-called aerodynamic "cold" test stands. Such vanes can be produced considerably more rapidly and at lower cost than corresponding vanes made of metal and thus are preferably utilized in these investigations. Vanes of plastic are loaded in the test stand at considerably lower temperatures (approximately 130° C.) compared to actual operation, but are subjected to forces of the same order of magnitude as in the actual drive turbine.

It is thus a problem to adopt the geometry of the outer and inner platforms of the vanes made of metal for those made of plastic, since the latter cannot withstand the high loads produced by the actual gas forces. Gluing or bonding together three or six vane elements into individual vane segments, from which the vane ring is formed has only slightly met this problem. Similarly, securing the vane elements by means of bolts at lateral front surfaces of the inner and outer platforms has not proven effective because the amplitude of vibration of the vanes was too high and led to breakage of the vanes.

SUMMARY OF THE INVENTION

An object of the invention is to provide a vane element of the above type which has an improved dynamic vibration behavior, which limits vibration amplitudes of adjacent vanes and can be produced by manufacturing technology in a simple and cost-favorable manner.

The above and further objects are achieved according to the invention in that at least the inner or outer platform has a projection with a lateral surface at a first lateral front surface, and a recess at an opposite lateral front surface, the recess being shaped to correspond to the projection, such that the projection of one vane element can be form-fit into the recess of an adjacent vane element so that the inner or outer platforms of adjacent vane elements are flush with one another.

This construction has the advantage that vane elements of adjacent vane segments, (formed, for example, by joining three vane elements together) are coupled in a form-fitting manner with one another in the axial direction and a damping effect is produced at the contact surfaces due to friction therebetween. The projections also seal any gaps that occur between the platforms.

In a preferred embodiment, the lateral surfaces of the projection extend at right angles to the first front surface of the outer or inner platform generally extending in the radial direction. The lateral surfaces of the projection therefore extend in the circumferential direction that is intensely loaded by the gas flow and achieve damping as a consequence of friction at the contact surfaces.

Preferably, the lateral surfaces of the projections project at least 3 mm from the first front surface of the inner or outer platform, so that a sufficiently high friction or contact surface is present in the recess of the adjacent vane element.

It is advantageous for the projection to constitute at least 30% and preferably at least 50% of the area of the first front surface in order to limit the vibration amplitude of the vane elements.

Further, it is preferred that the projection fits with a small play in the recess of the adjacent vane element so that, for example, the vane elements of adjacent vane segments can move towards and away from one another to accommodate thermal expansion.

Most preferably, the inner surfaces of the recess at the second front surface extend parallel to the lateral surfaces of the projection, so that secure friction contact is assured between the inner surfaces of the recess and the lateral surfaces of the projection.

It is preferred that the outer platform comprises a flange integral with the vane and an outer reinforcing wall, which are joined by means of two transverse webs extending circumferentially at axially spaced locations, and/or that the inner platform comprises a flange integral with the vane and a reinforcing wall. In this way, resistance to bending and twisting of the platforms is obtained. The resistance to bending and twisting is particularly effective for the outer platform consisting of the flange, the outer reinforcing wall, the two transverse webs, and the fastening means attaching the vane element to the drive housing. Due to this arrangement, the vane element also resists relatively high actual gas forces, even when made from relatively weak materials, such as, for example, fiber-reinforced plastic.

In a preferred embodiment, the vane element is formed as an integral one-piece body so that it can be made inexpensively from metal or by injection molding processes.

It is particularly preferred that the vane element be made of carbon-fiber-reinforced plastic, so that it can be investigated in so-called aerodynamic "cold" test stands. In this way, test data for the calibrating of aerodynamic dimensioning processes can be determined more rapidly and in a more cost-favorable manner, than is the case of the vane elements made of metal. Such test vane elements of plastic also can be joined by bonding or gluing three or six vane elements together to form a vane segment. The lateral surfaces of the projections serve for the application of adhesive, which, in contrast to the first and second front surfaces of the conventional inner or outer platforms, resist the circumferentially applied forces in shear rather than in tension or compression. This is clearly a more favorable form of loading for glued joints.

BRIEF DESCRIPTION OF THE FIGURES OF THE DRAWING

The invention will be described hereafter with reference to an embodiment illustrated in the drawing wherein.

DETAILED DESCRIPTION

Figure 1:
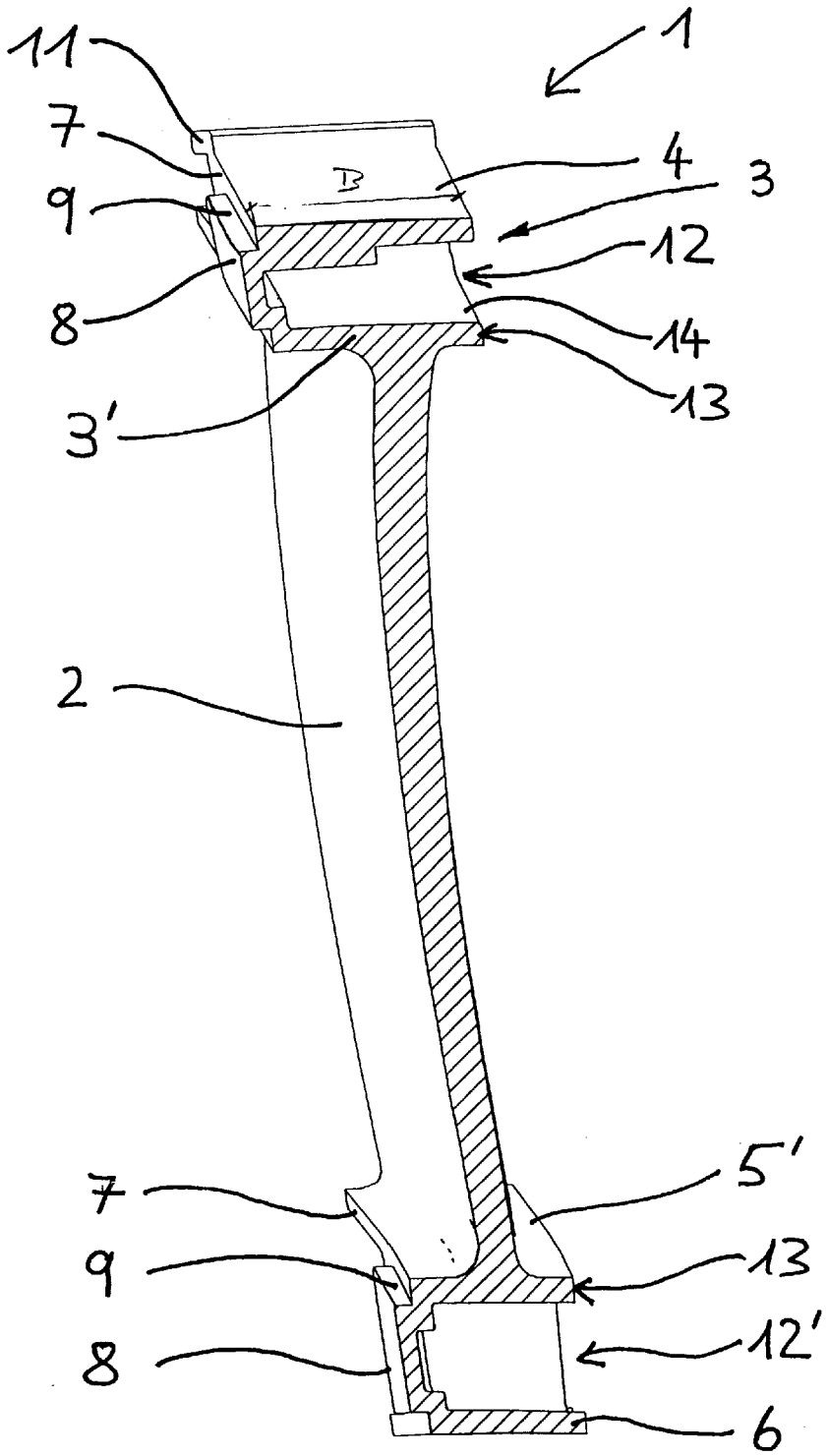
FIG. 1 is a longitudinal sectional view of a vane element according to an embodiment of the invention shown in perspective.

FIG. 1 shows an embodiment of a vane element 1 according to the invention. The vane element 1 is made of carbon-fiber-reinforced plastic and is produced by injection molding. The vane element 1 is utilized in so-called aerodynamic "cold" test stands in order to rapidly and inexpensively determine test data from pressure, velocity, and flow quantity measurements for calibrating aerodynamic dimensioning processes.

Vane element 1 comprises a vane blade 2 integrally formed with an outer platform 3 and an inner platform 5. The outer platform 3 comprises a flange 3' integral with the vane blade 2 and an outer reinforcing wall 4 spaced outwardly from flange 3'. The inner platform 5 comprises a flange 5' integral with the vane blade 2. The inner and outer platforms 3 and 5 each has a first front surface 7 provided with a projection 8, which forms a lateral surface 9 projecting from the first front surface 7 by approximately 3 mm. In the case of development of very high forces, the lateral surface 9 can project a distance of 5 mm or more.

A number of vane elements 1 are assembled as an annular ring and are attached in a drive housing. The vane blade 2 extends between the inner and outer platforms 5 and 3 essentially in a radial direction of the drive assembly.

Figure 2:
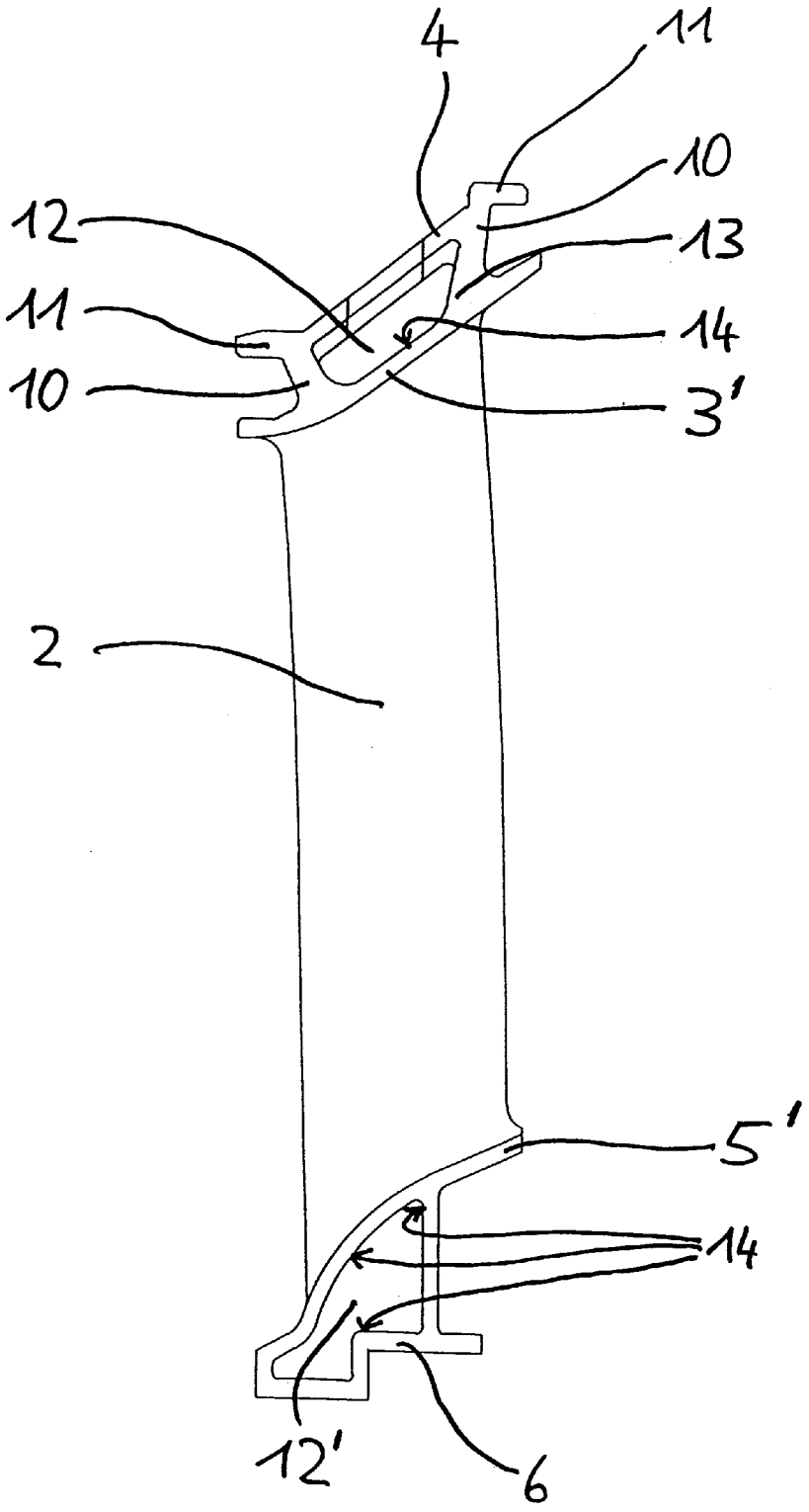
FIG. 2 is a side elevational view of the vane element of FIG. 1.

FIG. 2 shows the wall 4 extending essentially parallel to flange 3' of the outer platform. Wall 6 at the inner platform 5 extends substantially parallel to flange 5'. Two hook-type projections 11 are formed on outer platform 3 for engaging the vane element 1 on a drive housing (not shown). A hollow space or recess 12 is formed between flange 3', wall 4 and a transverse web 10 extending between projections 11 at the outer platform, the flange, wall and web having substantially equal thickness. A similar space or recess 12' is formed in the inner platform between flange 5' and wall 6. The inner and outer platforms 3 and 5 are formed with second front surfaces 13 at the openings of recesses 12 and 12'. The recesses 12 and 12' have shapes corresponding to their opposite respective projections 8 so that the projections 8 of an adjacent vane element can be form-fitted in the recesses to interlock the vane elements together.

Figure 4:
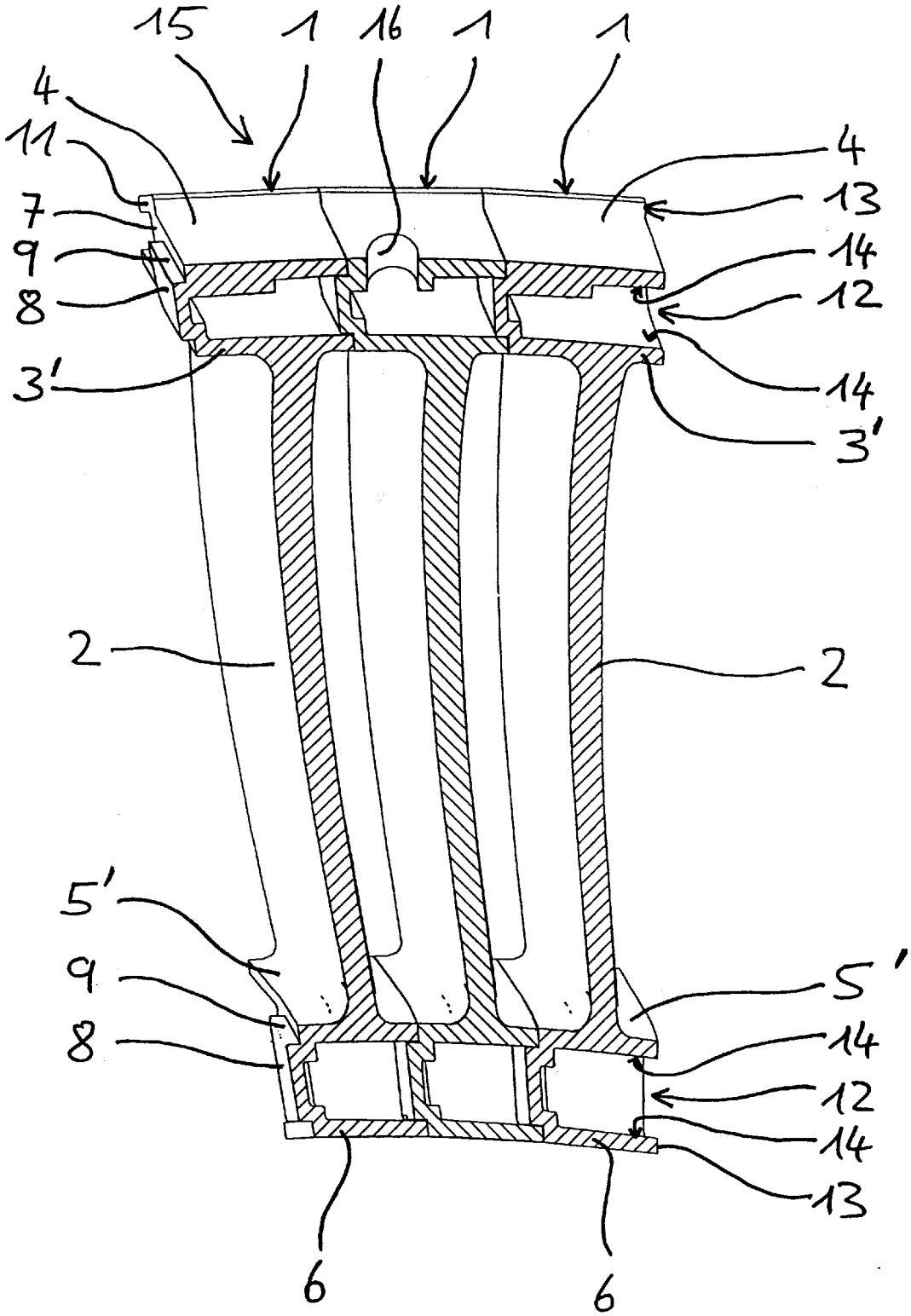
FIG. 4 is a longitudinal section of a vane segment comprised of three vane elements shown in perspective.
Figure 5:
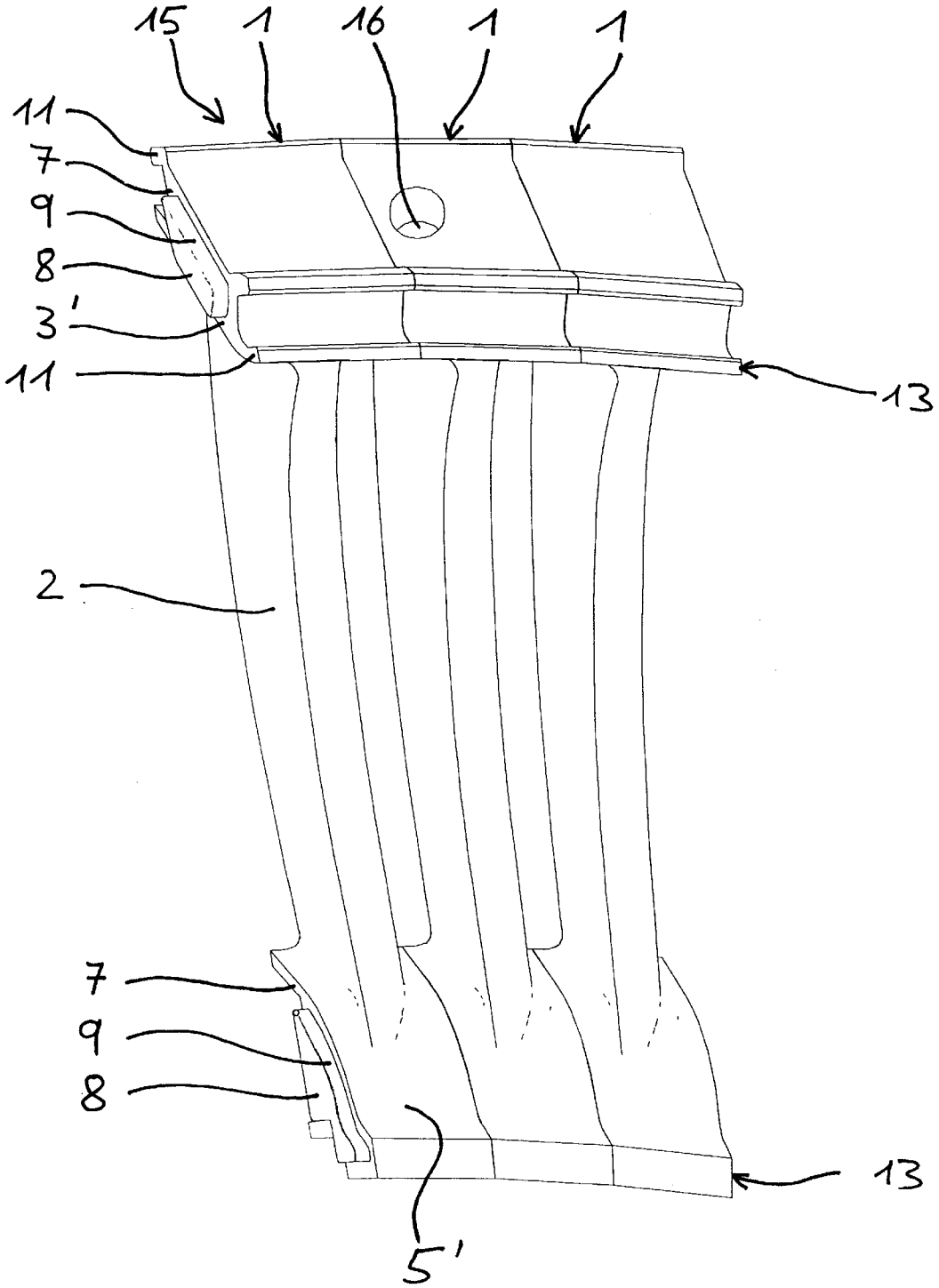
FIG. 5 is a perspective view of the vane segment in FIG. 4.

When assembling the vane elements 1 to form the annular ring, the projections 8 of one vane element 1 are inserted into the recesses 12 and 12' of an adjacent vane element. The dimensions of the projections and the recesses are closely matched to one another so that the projections fit tightly into the recesses and the surfaces of the inner and outer platforms of adjacent vane elements are flush with one another as seen in FIGS. 4 and 5. Recesses 12 and 12' have inner surfaces 14 open at surface 13, and in the assembled state, surfaces 14 contact lateral surfaces 9 of projections 8 because of the dimensional conformance of projections 8 and recesses 12 and 12'. In this way, a seal is also produced between adjacent vane elements 1. As can be seen in FIG. 2 the projections 8 and recess 12 and 12' make up more than 50% of the cross-sectional surface area lying in the plane of the first or second surface 7 or 13. This will insure adequate interfitting of the projections within the recesses.

Figure 3:
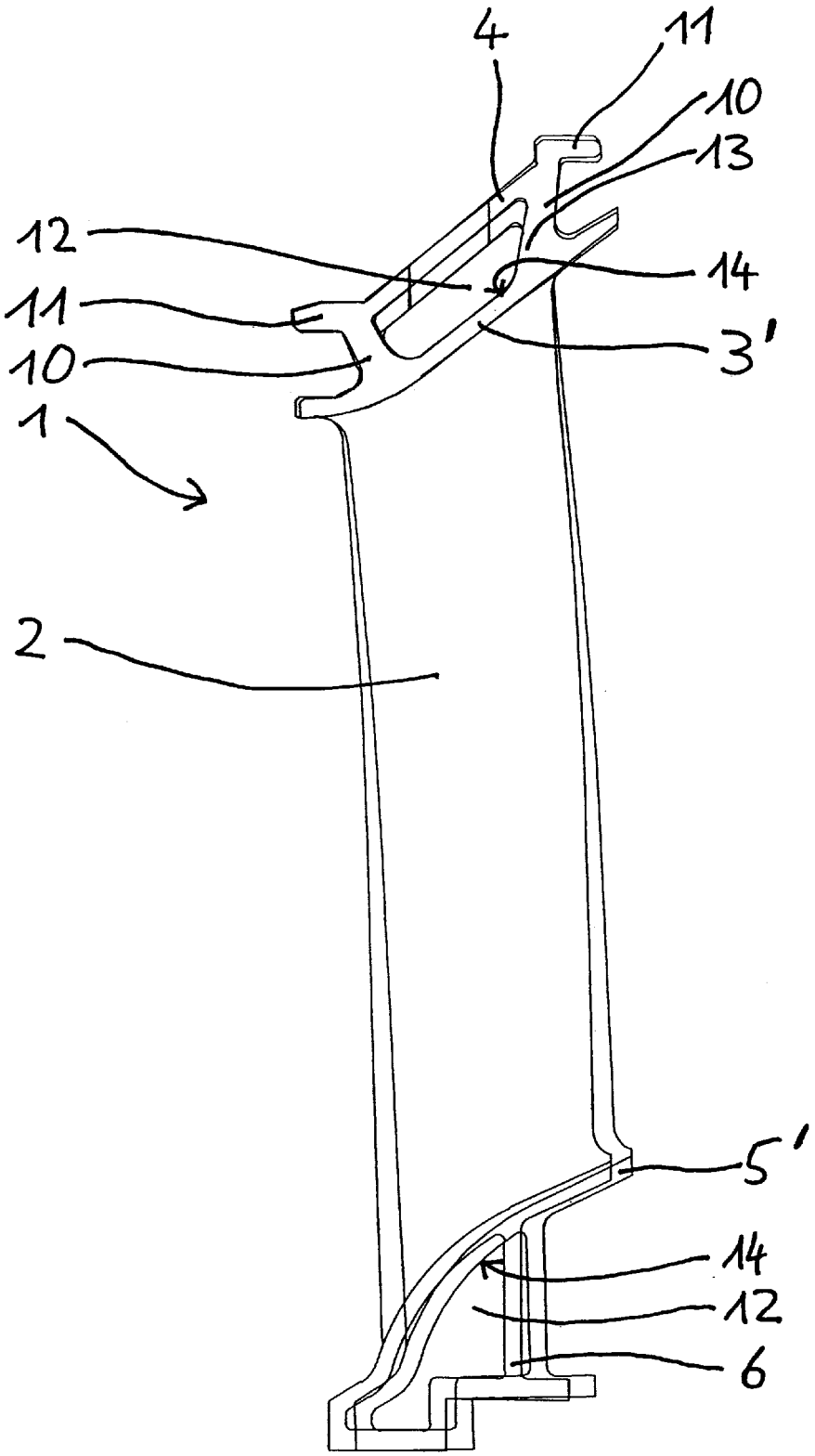
FIG. 3 is a side view of the vane element diagrammatically illustrating the vibration thereof.

FIG. 3 diagrammatically shows the vibration pattern of a single vane element 1 in the radial and axial directions, whereby two distinct vibration states are obtained. The vibration amplitude that is particularly evident in FIG. 3 at flange 5' or wall 6 at inner platform 5 is effectively limited according to the invention when the vane elements 1 are assembled into the annular ring due to the tight fitting engagement of projections 8 into recesses 12' of adjacent vane elements 1. Damping of the vibration is also produced by the friction developed between inner surfaces 14 of recess 12' and lateral surfaces 9 of projections 8.

FIG. 4 shows a vane segment 15 comprised of three vane elements 1. An annular ring is formed from a plurality of interfitted vane segments. Vane elements 1 made of plastic are joined not only by the form-fit between projections 8 and recesses 12, 12' of adjacent vane elements 1, but also by the friction present between the contact surfaces. The adjacent vane elements 1 can also be glued or bonded together at least at lateral surface 9 of projection 8 and inner surfaces 14 of recesses 12, 12'. The bonded joint between lateral surfaces 9 of projections 8 and inner surfaces 14 of recesses 12, 12' is subject to shear stress by the loads produced during operation and thus is capable of resisting much greater loads than when stressed in tension or compression.

In order to form an annular ring of vane elements, several vane segments 15 are joined together without being glued or bonded to one another so as to compensate for thermal expansion. Hence, the segments are only coupled together by the form fit between projections 8 and recesses 12, 12' of adjacent segments. The form fit, however, produces a damping effect due to the friction between lateral surfaces 9 of projections 8 and inner surfaces 14 of recesses 12, 12'. This brings about an improvement in the dynamic vibration behavior of vane elements 1. In addition, the limiting of the vibration amplitude and a sealing of the gaps between adjacent vane segments are produced by the form fit of the projections in the recesses.

A hole 16 is provided in each vane element 1 of a vane segment 15 in the wall 4 of outer platform 3. A bolt (not shown) in the housing (also not shown) engages in hole 16 and supports the vane segment to resist gas flow forces in the circumferential direction. As shown in FIG. 4, wall 4 is thickened locally around hole 16 for reducing stress concentrations. Hole 16 extends in the radial direction of the drive assembly and forces developed by the gas flow acting axially are resisted by the connection of the hook members 11 and not by the bolts.

FIG. 5 shows vane segment 15 in a perspective view, in which the profile of vane blades 2 can be clearly seen. It can further be seen that the dimensions of projections 8 and recesses 12, 12' closely correspond to one another, so that the outer and inner platforms 3 and 5 are flush in the assembled state. When a number of segments 15 are assembled to form an annular ring, the projections 8 at the left side of segment 15 in FIG. 5 are fitted into the recesses of the adjacent segment without gluing or bonding.

Although the invention has been described in relation to specific embodiments thereof, it will become apparent to those skilled in the art that numerous modifications and variations can be made within the scope and spirit of the invention as defined in the attached claims.

What is claimed is:

1. A vane construction for a gas turbine comprising an assembly of vane elements, each vane element including a vane blade and outer and inner platforms at upper and lower ends of said vane blade, said outer and inner platforms being integrally formed with said vane blade, said outer platform having means for attachment to a housing, at least one of said platforms having a first surface with a projection extending laterally from said first surface, said projection having upper and lower surfaces extending perpendicularly from said first surface, said at least one platform further having a second surface with a recess disposed opposite said projection and of a shape corresponding to that of said projection such that in the assembly of vane elements, said projection of one vane element form-fits into the recess of an adjacent vane element and the platforms of the adjacent vane elements are flush with one another, so as to be restrained thereby to prevent relative radial movement of said vane elements.

2. A vane construction as claimed in claim 1, wherein said projection projects at least 3 mm from said first surface.

3. A vane construction as claimed in claim 1, wherein said projection projects at least 5 mm from said first surface.

4. A vane construction as claimed in claim 1, wherein said projection and said recess respectively constitute at least 30% of the surface area of said first and second surfaces.

5. A vane construction as claimed in claim 1, wherein said projection and said recess respectively constitute at least 50% of the surface area of said first and second surfaces.

6. A vane construction as claimed in claim 1, wherein said projection of one vane element is fitted in the recess of an adjacent vane element without bonding.

7. A vane construction as claimed in claim 1, wherein said projection has a lateral surface and said recess has an inner surface arranged so that when the projection of said one vane element is fitted in the recess of the adjacent vane element, the lateral surface of the projection adjoins and is parallel to the inner surface of the recess.

8. A vane construction as claimed in claim 1, wherein each of said platforms includes a flange integral with said vane blade and an outer wall secured to said flange.

9. A vane construction as claimed in claim 8, wherein said outer wall extends parallel to said flange.

10. A vane construction as claimed in claim 8, comprising transverse webs joining said flange of said outer platform to said wall of said outer platform, said webs extending circumferentially of said vane element over the entire circumferential width of the outer platform.

11. A vane construction as claimed in claim 10, wherein said flanges, outer walls and webs have uniform thickness.

12. A vane construction as claimed in claim 10, wherein said flanges, outer walls and cross struts have substantially equal thickness.

13. A vane construction as claimed in claim 1, wherein said vane element is made of fiber reinforced plastic material.

14. A vane construction as claimed in claim 1, wherein said vane element is made of metal.

15. A vane construction as claimed in claim 1, wherein the lateral surface of said projection of one vane element is bonded in the recess in the adjacent vane element.

16. A vane construction as claimed in claim 1, wherein the outer platform of said vane element is provided with a radial hole to receive a bolt for connection to the housing.

17. A vane construction as claimed in claim 1, wherein a plurality of vane elements are assembled to form a vane segment, the projections on the vane elements of said segment being engaged and bonded in the recesses of the adjacent vane elements.

18. A vane construction as claimed in claim 17, wherein a plurality of vane segments are assembled to form a vane ring in which the projection at one side of one vane segment is engaged in the recess at an opposite side of an adjacent vane segment.

19. A vane construction as claimed in claim 1, wherein said projections and said recesses of the vane elements are interengagable so that the assembly of vane elements is secured in a circumferential direction, said platforms engaging said projections to prevent relative radial movement of the vane elements in said assembly.

20. A vane construction as claimed in claim 8, wherein said flange and said outer wall of each platform extend substantially parallel to one another and define a U-shape configuration, said projection being at a closed end of the U-shape configuration and said recess being formed between the flange and the outer wall, said projection of one vane element when extending into the recess of the adjacent vane element being engaged between the flange and the outer wall of said other vane element so as to be restrained thereby to prevent the relative radial movement of said vane elements.

* * * * *